US009789727B1

(12) United States Patent
Phillips et al.

(10) Patent No.: US 9,789,727 B1
(45) Date of Patent: Oct. 17, 2017

(54) TACTILE STIMULATION SYSTEM

(71) Applicants: Stefanie Phillips, Pearland, TX (US); Landon Phillips, Pearland, TX (US)

(72) Inventors: Stefanie Phillips, Pearland, TX (US); Landon Phillips, Pearland, TX (US)

( * ) Notice: Subject to any disclaimer, the term of this patent is extended or adjusted under 35 U.S.C. 154(b) by 0 days.

(21) Appl. No.: 15/182,786

(22) Filed: Jun. 15, 2016

(51) Int. Cl.
*B43K 23/008* (2006.01)
*B43K 29/00* (2006.01)

(52) U.S. Cl.
CPC ..... *B43K 23/008* (2013.01); *B43K 29/00* (2013.01)

(58) Field of Classification Search
CPC combination set(s) only.
See application file for complete search history.

(56) References Cited

U.S. PATENT DOCUMENTS 4,983,062 A 1/1991 Hour
D422,308 S 4/2000 Chuang
6,149,330 A 11/2000 Chuang
6,158,914 A 12/2000 Junkins
6,254,298 B1 * 7/2001 Hsu ..... B43K 29/00 401/195
6,612,766 B2 * 9/2003 Collins ..... B43K 7/005 401/195
7,275,744 B1 10/2007 Kuo
7,774,963 B2 * 8/2010 Puglisi ..... G09F 23/00 40/334
8,790,150 B2 7/2014 Truckai
2007/0059089 A1 * 3/2007 Junkins ..... B43K 5/005 401/195

FOREIGN PATENT DOCUMENTS

WO WO2012023948 2/2012

* cited by examiner

*Primary Examiner* — David Walczak

(57) ABSTRACT

A tactile stimulation system includes a writing utensil that may be manipulated thereby facilitating the writing utensil to write. A plurality of blocks is provided. The blocks are movably coupled together and the plurality of blocks may be manipulated. The writing utensil is coupled to the plurality of blocks. Thus, the plurality of blocks facilitates tactile stimulation when the writing utensil is manipulated.

6 Claims, 4 Drawing Sheets

TACTILE STIMULATION SYSTEM

BACKGROUND OF THE DISCLOSURE

Field of the Disclosure

The disclosure relates to stimulation devices and more particularly pertains to a new stimulation device for combining tactile stimulation with a writing utensil.

SUMMARY OF THE DISCLOSURE

An embodiment of the disclosure meets the needs presented above by generally comprising a writing utensil that may be manipulated thereby facilitating the writing utensil to write. A plurality of blocks is provided. The blocks are movably coupled together and the plurality of blocks may be manipulated. The writing utensil is coupled to the plurality of blocks. Thus, the plurality of blocks facilitates tactile stimulation when the writing utensil is manipulated.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
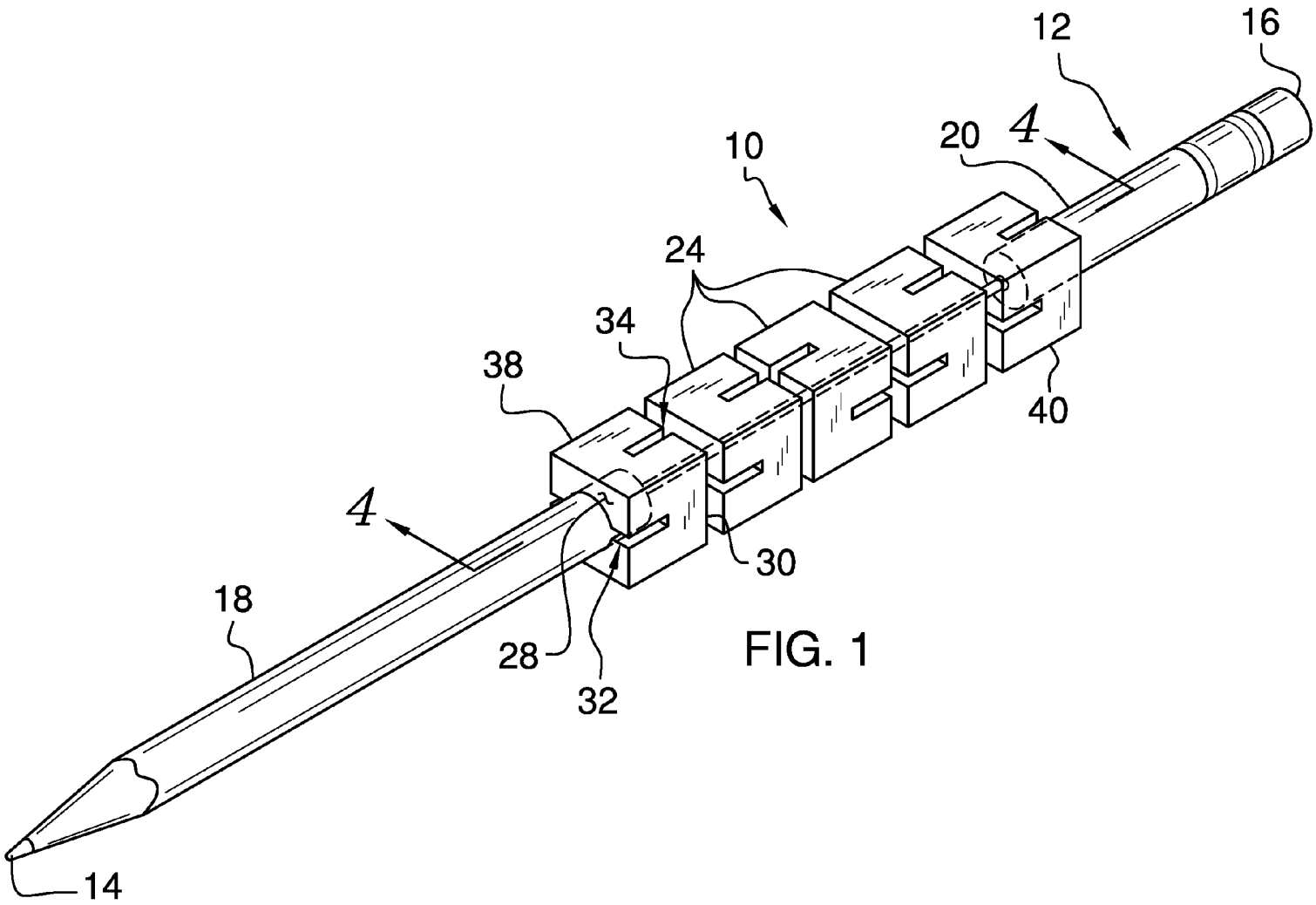
FIG. 1 is a perspective view of a tactile stimulation system according to an embodiment of the disclosure.
Figure 2:
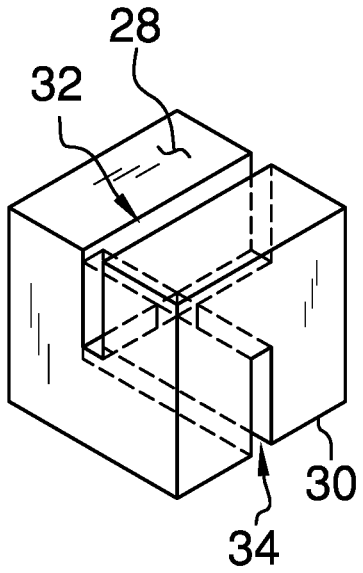
FIG. 2 is a perspective view of a block of an embodiment of the disclosure.
Figure 3:
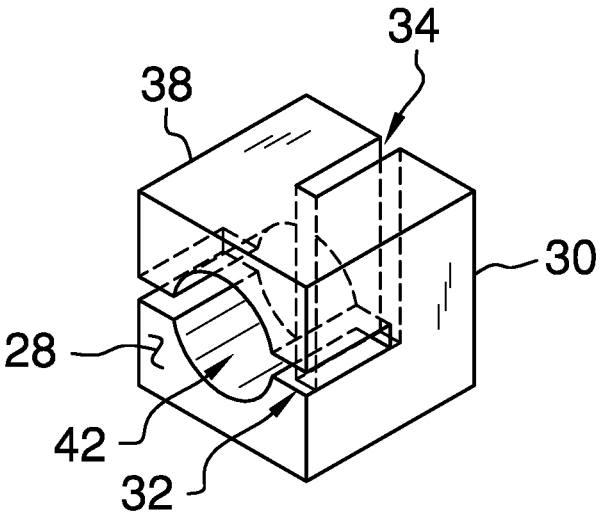
FIG. 3 is a front perspective view of block of an embodiment of the disclosure.
Figure 4:
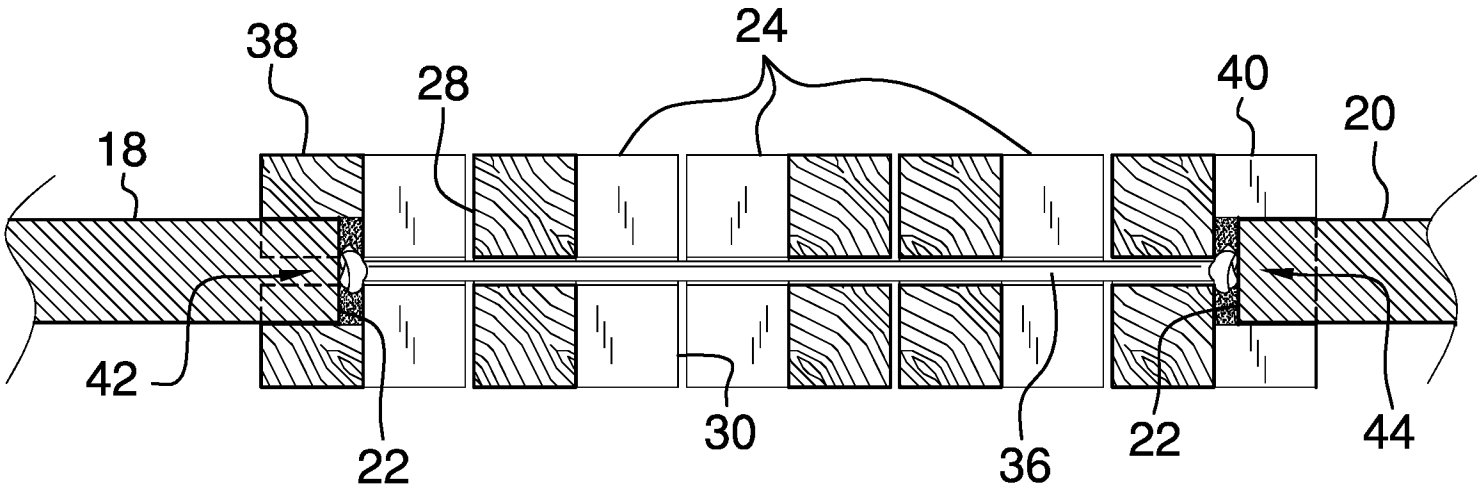
FIG. 4 is a cross sectional view taken along line 4-4 of FIG. 1 of an embodiment of the disclosure.
Figure 5:
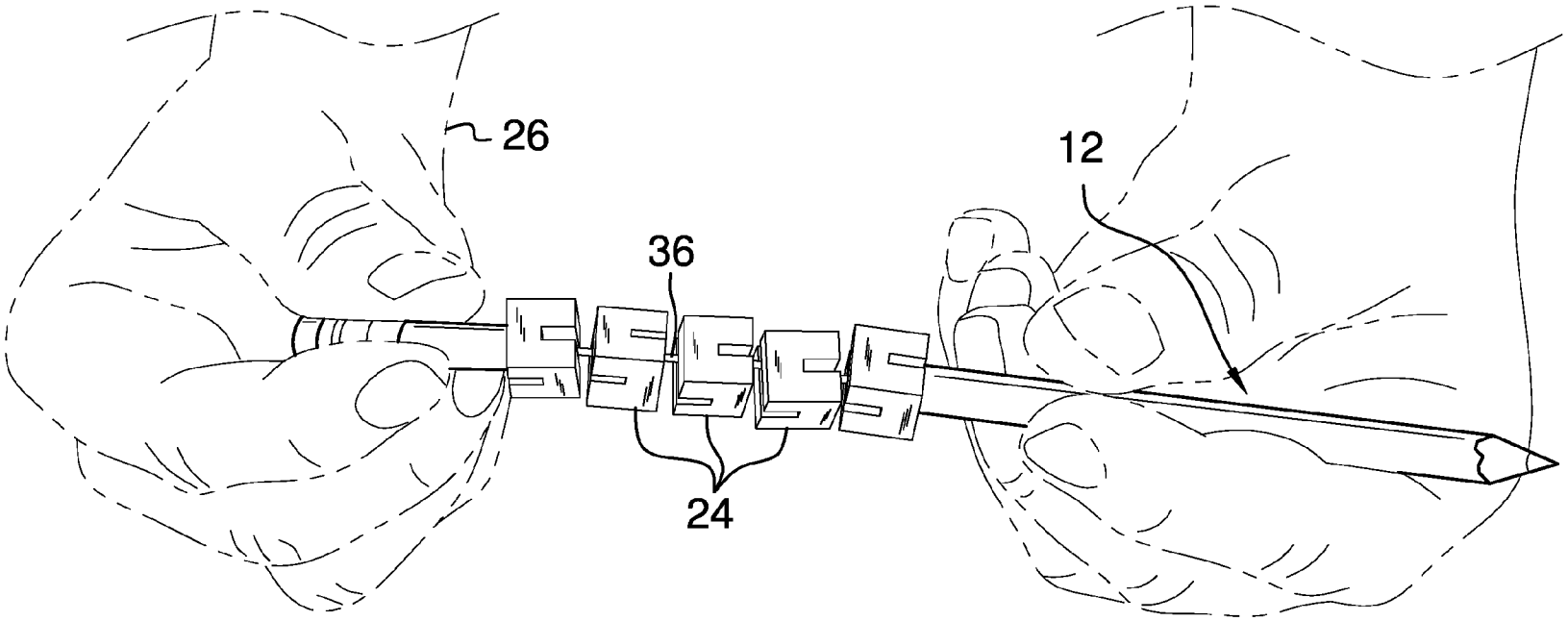
FIG. 5 is a perspective in-use view of an embodiment of the disclosure.

With reference now to the drawings, and in particular to FIGS. 1 through 5 thereof, a new stimulation device embodying the principles and concepts of an embodiment of the disclosure and generally designated by the reference numeral 10 will be described.

As best illustrated in FIGS. 1 through 5, the tactile stimulation system 10 generally comprises a writing utensil 12. The writing utensil 12 may be manipulated thereby facilitating the writing utensil 12 to write. The writing utensil 12 may comprise a wooden pencil or the like. The writing utensil 12 has a first end 14 and a second end 16. The writing utensil 12 is divided into a first half 18 and a second half 20. Each of the first half 18 and the second half 20 has an engaging end 22.

A plurality of blocks 24 is provided. The blocks 24 are movably coupled together and the plurality of blocks 24 may be manipulated. The writing utensil 12 is coupled to the plurality of blocks 24. Thus, the plurality of blocks 24 facilitates tactile stimulation when the writing utensil 12 is manipulated. The plurality of blocks 24 may facilitate a user 26 with ADHD or ADD to remain focused when the user 26 manipulates the writing utensil 12. Moreover, the plurality of blocks 24 emits a minimum amount of noise when the blocks 24 are manipulated. Thus, the user 26 is inhibited from disturbing others while the user 26 manipulates the blocks 24.

Each of the blocks 24 has a first surface 28 and a second surface 30. The first surface 28 is oriented parallel with the second surface 30. A first notch 32 extends inwardly on the first surface 28 toward the second surface 30. The first notch 32 extends across an entire width of the first surface 28. Moreover, the first notch 32 is centrally positioned on the first surface 28.

A second notch 34 extends inwardly on the second surface 30 toward the first surface 28. The second notch 34 extends across an entire width of the second surface 30. The second notch 34 is centrally positioned on the second surface 30. Moreover, the second notch 34 is oriented transverse with the first notch 32.

An elastic member 36 is provided. The elastic member 36 is coupled between each of the plurality of blocks 24. Thus, the plurality of blocks 24 is arranged in a line. The first surface 28 of each of the blocks 24 faces the second surface 30 of an adjacent one of the blocks 24. The elastic member 36 may be comprised of a resiliently stretchable material such as rubber or the like.

The plurality of blocks 24 includes a front block 38 and a back block 40. The first surface 28 corresponding to the front block 38 has a first well 42 extending inwardly toward the second surface 30 of the front block 38. The first well 42 is centrally positioned on the first surface 28 of the front block 38. The first well 42 insertably receives the engaging end 22 corresponding to the first half 18 of the writing utensil 12. Thus, the first end 14 of the writing utensil 12 is exposed for writing.

The second surface 30 corresponding to the back block 40 has a second well 44 extending inwardly toward the first surface of the back block 40. The second well 44 is centrally positioned on the second surface 30. The second well 44 insertably receives the engaging end 22 corresponding to the second half 20 of the writing utensil 12. Thus, the second end 16 of the writing utensil 12 is exposed for erasing or the like.

In use, the writing utensil 12 is gripped for the purposes of writing. The user 26 manipulates the blocks 24 while the user 26 grips the writing utensil 12. Thus, the blocks 24 facilitate tactile stimulation for the user 26 while the user 26 grips the writing utensil 12. The tactile stimulation facilitates the user 26 to remain focused on the task of writing. Moreover, the blocks 24 make a minimum amount of sound when the user 26 manipulates the blocks 24. Thus, the user 26 may manipulate the blocks 24 in a public environment without disturbing others.

With respect to the above description then, it is to be realized that the optimum dimensional relationships for the parts of an embodiment enabled by the disclosure, to include variations in size, materials, shape, form, function and manner of operation, system and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

We claim:

1. A tactile stimulation system comprising:

a writing utensil being configured to be manipulated thereby facilitating said writing utensil to write; and a plurality of blocks, said blocks being movably coupled together wherein said plurality of blocks is configured to be manipulated, said writing utensil being coupled to said plurality of blocks wherein said plurality of blocks is configured to facilitate tactile stimulation when said writing utensil is manipulated, each of said blocks comprising a first surface and a second surface, said first surface being oriented parallel with said second surface, a first notch extending inwardly on said first surface toward said second surface, said first notch extending across an entire width of said first surface, said first notch being centrally positioned on said first surface, and a second notch extending inwardly on said second surface toward said first surface, said second notch extending across an entire width of said second surface, said second notch being centrally positioned on said second surface, said second notch being oriented transverse with said first notch.

2. The system according to claim 1, wherein said writing utensil having a first end and a second end, said writing utensil being divided into a first half and a second half, each of said first half and said second half having an engaging end.

3. The system according to claim 1, further comprising:

each of said blocks having a first surface and a second surface; and an elastic member being coupled between each of said plurality of blocks, said plurality of blocks being arranged in a line having said first surface of each of said blocks facing said second surface of an adjacent one of said blocks, said plurality of blocks including a front block and a back block.

4. The system according to claim 3, wherein:

said writing utensil has a first half, said first half having an engaging end; and said first surface corresponding to said front block has a first well extending inwardly toward said second surface of said front block, said first well being centrally positioned on said first surface of said front block, said first well insertably receiving said engaging end corresponding to said first half of said writing utensil.

5. The system according to claim 3, wherein:

said writing utensil has a second half, said second half having an engaging end; and said second surface corresponding to said back block has a second well extending inwardly toward said first surface of said back block, said second well being centrally positioned on said second surface of said back block, said second well insertably receiving said engaging end corresponding to said second half of said writing utensil.

6. A tactile stimulation system comprising:

a writing utensil being configured to be manipulated thereby facilitating said writing utensil to write, said writing utensil having a first end and a second end, said writing utensil being divided into a first half and a second half, each of said first half and said second half having an engaging end; and a plurality of blocks, said blocks being movably coupled together wherein said plurality of blocks is configured to be manipulated, said writing utensil being coupled to said plurality of blocks wherein said plurality of blocks is configured to facilitate tactile stimulation when said writing utensil is manipulated, each of said blocks comprising:

a first surface and a second surface, said first surface being oriented parallel with said second surface, a first notch extending inwardly on said first surface toward said second surface, said first notch extending across an entire width of said first surface, said first notch being centrally positioned on said first surface, a second notch extending inwardly on said second surface toward said first surface, said second notch extending across an entire width of said second surface, said second notch being centrally positioned on said second surface, said second notch being oriented transverse with said first notch, an elastic member being coupled between each of said plurality of blocks, said plurality of blocks being arranged in a line having said first surface of each of said blocks facing said second surface of an adjacent one of said blocks, said plurality of blocks including a front block and a back block, said first surface corresponding to said front block having a first well extending inwardly toward said second surface of said front block, said first well being centrally positioned on said first surface of said front block, said first well insertably receiving said engaging end corresponding to said first half of said writing utensil, and said second surface corresponding to said back block having a second well extending inwardly toward said first surface of said back block, said second well being centrally positioned on said second surface of said back block, said second well insertably receiving said engaging end corresponding to said second half of said writing utensil.

* * * * *